United States Patent [19]

Sidler

[11] Patent Number: 4,493,268

[45] Date of Patent: Jan. 15, 1985

[54] SAFE KEEPING BOX ASSEMBLY

[76] Inventor: Karl Sidler, 420 Touzin Ave., Dorval, Quebec, Canada, H9S 2N2

[21] Appl. No.: 493,241

[22] Filed: May 10, 1983

[51] Int. Cl.[3] ..... E05G 1/04

[52] U.S. Cl. ..... 109/52; 109/59 T; 109/73; 70/63

[58] Field of Search ..... 109/50–52, 109/59 R, 58, 59 T, 64, 70, 73; 70/63, 158–162, DIG. 57, 232

[56] References Cited

U.S. PATENT DOCUMENTS

| | | | |
|---|---|---|---|
| 1,026,649 | 5/1912 | Beshore | 109/50 |
| 1,105,826 | 9/1914 | Norton | 49/389 |
| 1,624,305 | 4/1927 | Anderson | 109/56 |
| 2,465,057 | 3/1949 | Brandes | 109/51 |
| 2,754,777 | 7/1956 | De Rosa, Sr. | 109/51 |
| 3,587,486 | 6/1971 | Heinrichs | 109/51 |
| 3,659,442 | 5/1972 | Cellini et al. | 70/63 |
| 3,715,998 | 2/1973 | Teleky | 109/58 |
| 3,741,132 | 6/1973 | Blower | 109/52 |
| 3,757,549 | 9/1973 | Mullis, Jr. | 70/232 |
| 4,029,370 | 6/1977 | Ziegel et al. | 109/51 |
| 4,051,790 | 10/1977 | Meditz et al. | 109/52 |
| 4,058,993 | 11/1977 | Stubbings | 70/63 |
| 4,098,199 | 7/1978 | Haje | 109/52 |
| 4,120,181 | 10/1978 | Stubbings | 70/63 |
| 4,193,353 | 3/1980 | Hinton et al. | 109/50 |
| 4,244,304 | 1/1981 | Read | 109/52 |
| 4,249,684 | 2/1981 | Miller et al. | 224/42.4 |

*Primary Examiner*—Robert L. Wolfe
*Assistant Examiner*—Neill Wilson
*Attorney, Agent, or Firm*—Robic, Robic & Associates

[57] ABSTRACT

A safety box assembly made up of a container having an access opening, a door hinged to the container for closing the access opening and a mounting base having a bottom wall secured to a supporting surface by means of screws or the like. The container is removably secured over the mounting base in such a manner that the fastening screws are covered by the container so as to become inaccessable. To secure the container on the base, there is provided a first bracket at the lower end of the door, this bracket having a locking wall extending toward the base inside the enclosure when the door is closed. A second bracket is provided on the mounting base and projects upwardly from the base bottom wall, further including a front wall that closes off a lower part of the opening and is disposed in space relationship with the door locking wall. The second bracket additionally has a container locking wall that extends over and above the bottom wall so that it, along with the door locking wall and the front wall, define a locking area. A locking rod is slid into the locking area, the ends of this rod being received in bearings of the container side walls, one of the bearings and the corresponding end of the locking rod being provided with a key operable locking mechanism. A releasable hooking structure is provided at the end of the container and of the mounting base which is away from the container opening.

10 Claims, 3 Drawing Figures

SAFE KEEPING BOX ASSEMBLY

BACKGROUND OF THE INVENTION

1. Field of the Invention

The present invention relates to a safety box assembly and more particularly to an assembly formed of a safety box, of the portable and carrying type, and of a mounting base, the latter being fastened on a supporting surface such as the wall of a room and at a selected location thereon. The assembly further includes a locking arrangement whereby the safety box may be released from the mounting base to be carried about, the base remaining on the supporting wall. The safety box assembly according to the present invention is conceived so that only by unlocking the locking arrangement and removing it from the assembly can the safety box be removed from the mounting base. Also, unless the safety box is unlocked and removed from the mounting base, it is not possible to unfasten the mounting base from the wall and therefore carry the whole assembly from the selected location.

An object of the present invention therefore lies in the provision of an assembly of the above type which can be extremely useful to anyone having to collect money or other valuables by motor vehicles, such as delivery trucks, milk trucks, taxi cabs or the like where important sums of money or other valuables are involved. In such instances, the base member is secured to the body of the vehicle and the safety box locked to it so that it can be removed only by the driver of the vehicle who has the key. With the safety box assembly of the invention, there is no other way to have access to the inside of the box but with the unlocking key nor is there any way to remove the box from its base member or tamper with it so that the valuables in the box are in an absolute safety, at least during the relatively short length of time the driver is away from the vehicle.

Greater safety from theft may be had also if the driver does not carry the key with him, a slot being provided through the box to place valuables therein, the slot being of course too narrow to allow hand access to the inside of the box. Since the above type of vehicles is nearly always in public view, a thief could not successfully hold up the driver since the latter would not have the key on him nor would the thief have sufficient time to dismantle the assembly by force before some police or other reinforcement becomes available.

The safety box assembly may also be extremely useful in public places such as hotels and motels where each room may be provided with a mounting base and a container, the locking arrangement in the form of a rod and lock, as will hereinafter be more fully disclosed, being available only at the hotel or motel desk and returned by the client upon leaving. Since many locking arrangements would be carried in stock, each having a particular locking combination but all being useable on any of the safety box and mounting base combinations, there would be no point for a prospective thief to have a copy made of a particular key since he will not know in which room the particular locking arrangement, to which the copied key fits, is located.

It will also be appreciated from the above comments that safety box assemblies according to the invention may be used with the same success in private and apartment houses, summer cottages, home offices, construction sites for the safe keeping of explosives, etc.

These assemblies could also be rented out by tool or appliance rental companies for the above-noted purpose.

In general, the above object of the invention lies in a safety box assembly for use where valuables are to be collected for a while and then the safety box removed from its base member for transportation to a safer place of storing.

2. Description of the Prior Art

A search was made prior to the preparation and filing of the instant application to determine the extent of novelty of the invention. This search has revealed the following U.S. Pat. Nos.:

1,105,826 of 1914
1,624,305 of 1927
2,465,057 of 1949
3,659,442 of 1972
3,715,998 of 1973
3,757,549 of 1973
4,051,790 of 1977
4,058,993 of 1977
4,120,181 of 1978.

Additionally, the following is a list of prior art U.S. patents cited, in an earlier application now abandoned, as pertinent to the claimed invention, the claims having however been deemed patentable thereover:

U.S. Pat. No. 1,026,649 of 1912
U.S. Pat. No. 2,465,057 of 1949
U.S. Pat. No. 3,587,486 of 1971
U.S. Pat. No. 3,741,132 of 1973
U.S. Pat. No. 4,051,790 of 1977
U.S. Pat. No. 4,098,199 of 1978
U.S. Pat. No. 4,193,353 of 1980
U.S. Pat. No. 4,244,304 of 1981.

However, none of the above patents can truly be considered directly relevant to the instant invention although some do anticipate the broad concept of using safety boxes for individual homes or apartments. Nevertheless, admittedly the provision of a fixed mounting base to which a container for valuables can be secured to prevent theft is known. Thus, such an arrangement is shown in U.S. Pat. No. 2,465,057. In the arrangement of this patent, the safety box can easily be moved between two or more fixed mounting bases and then securely locked to whatever mounting base it is applied to.

It is noticeable however that the known safety box assemblies are quite complicated in construction and require one locking means to secure the safety box to the mounting base and another lock to secure the door to the box.

In order to be of any value, however, a safety box assembly of this nature has to be quite simple not only in operation, being intended for people not normally apt to handle complicated constructions and having little time to spend in studying how a device works, but because such assemblies have to be by nature low in selling price, installation and maintenance costs.

It is consequenlty a main object of the present invention to provide an improved safety box assembly which incorporates the above advantages of ease and use, construction and maintenance costs. The simplicity in construction must also allow the use of sturdy metallic components as is the case in any safety box assemblies.

In accordance with the present invention, these objects are achieved in a safety box assembly which, as herein broadly claimed, comprises:

(a) a container defining an enclosure for the safekeeping of valuables and having wall edges at one end defining an opening;

(b) a door hinged to said container for closing said opening;

(c) a mounting base having a bottom wall and means for fastening the bottom wall to a supporting surface;

(d) means to removably secure said container on said mounting base over said fastening means whereby to render said fastening means inaccessible, when said container is so secured, said securing means comprising, when said container is secured on the base:

a first bracket at the end of said door adjacent said mounting base, said first bracket having a door locking wall extending toward said base and located inside said enclosure in closed position of said door;

a second bracket upstanding from said bottom wall of said base and including a front wall closing off a lower part of said opening and disposed in space relationship with said door locking wall; said second bracket further including a container locking wall extending over and above said bottom wall between said door locking wall and said container locking wall; said door locking wall, said container locking wall and said front wall defining a locking area;

a locking rod slid into said locking area;

means on two opposed ones of said container wall edges to hold and releasably lock said locking rod within said locking area, and releasable interlocking means at the end of said container away from said opening and at the corresponding end of said mounting base to hold said container end on said mounting base;

whereby with said locking rod in said locking area, opening of said door is prevented by abutment of said door locking wall against said locking rod and lifting of said container away from said mounting base is prevented by abutment of said locking rod against said container locking wall and operative engagement of said interlocking means, removal of said locking rod from said locking area freeing said door which can then be opened and freeing said container which can then be lifted from said mounting base.

In a preferred form of the invention, the locking rod holding and the locking means comprises: bearing means on both the container opposed wall edges with one of the wall edges being further provided with a rod aperture leading into the bearing means and consequently in the locking area for the proper insertion of the locking rod, and a key operable locking mechanism provided at one end of the rod and in one of the bearing means, this mechanism being suitable to lock the rod in the locking area.

It is also a constructional advantage that the first and second brackets be respectively integral parts of the door and of the mounting base, the first bracket being formed by the bottom edge of the door by bending it twice at 90°. Similarly, the second bracket is formed by bending the front edge of the bottom wall twice at 90°.

A preferable releasable interlocking means comprises: a hook which is formed at the end of the bottom wall away from the container opening and an upturned flange projecting from the end of the container away from the front opening, the upturned flange being receivable within the bottom wall hook to hold the container end on the mounting base.

The door may be hinged to the container for pivotal action about an axis which is perpendicular to the bottom wall of the mounting base. Likewise, it may be hinged to pivot about an axis which is parallel to the mounting base.

Advantageously, a slot is provided through the top wall of the container which gives only limited access thereto suitable for the insertion of valuables but nevertheless of a size suitable to prevent hand access into the container. A handle may be formed around this slot for carrying the container when it is released from the mounting base.

In another preferred embodiment, the bottom wall of the container may be bent up inwardly of the enclosure to stand behind the door locking wall so as to serve as stop therefor, when the door is closed.

Additionally, the container locking wall may be formed with a central downwardly directed ridge intended to bear on and guide the locking rod when the latter is inserted into the locking area.

A preferred embodiment of the invention will now be described in detail having reference to the accompanying drawings wherein.

Figure 1:
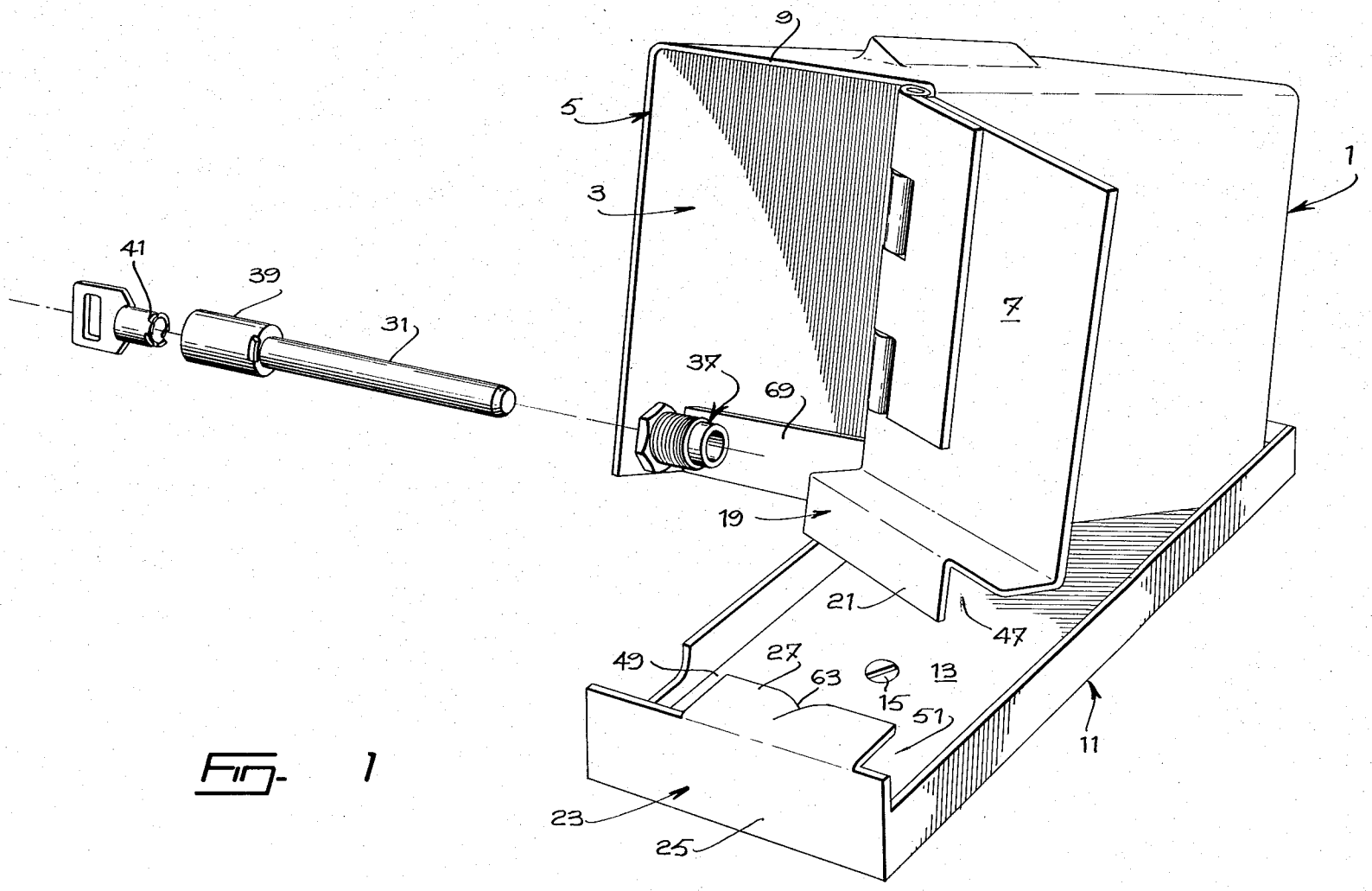
FIG. 1 is a perspective view of a safety box assembly, made according to the invention, wherein the container is shown being mounted on the base member and the locking rod shown ready to be inserted into position.

As shown, the safety box assembly comprises a container 1 defining an enclosure 3 for the safekeeping of valuables, such as money and jewels, and having wall edges at one end defining an access opening 5. A door 7 is hinged to the container 1 in any known manner to allow it to swing about an axis which is perpendicular to the base of the container 1. The ensuing description will make it understandable that the door 7 may likewise be hinged along the top edge 9 of the container 1 for pivotal action about a horizontal axis.

Figure 2:
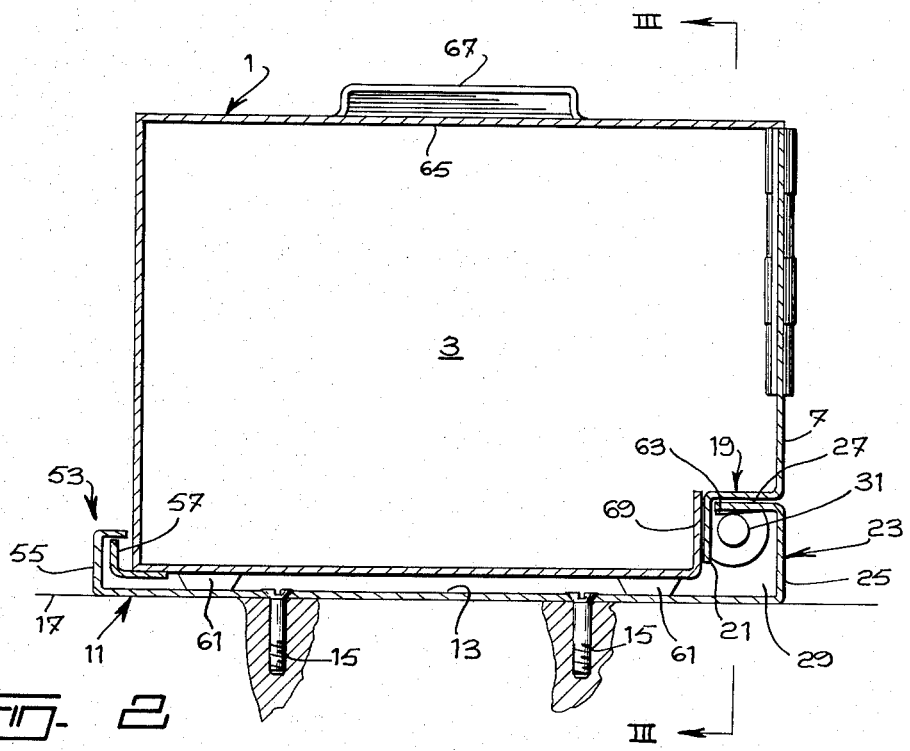
FIG. 2 is a longitudinal cross-sectional view of the safety box assembly of FIG. 1, taken in a plane along line II—II of FIG. 3.
Figure 3:
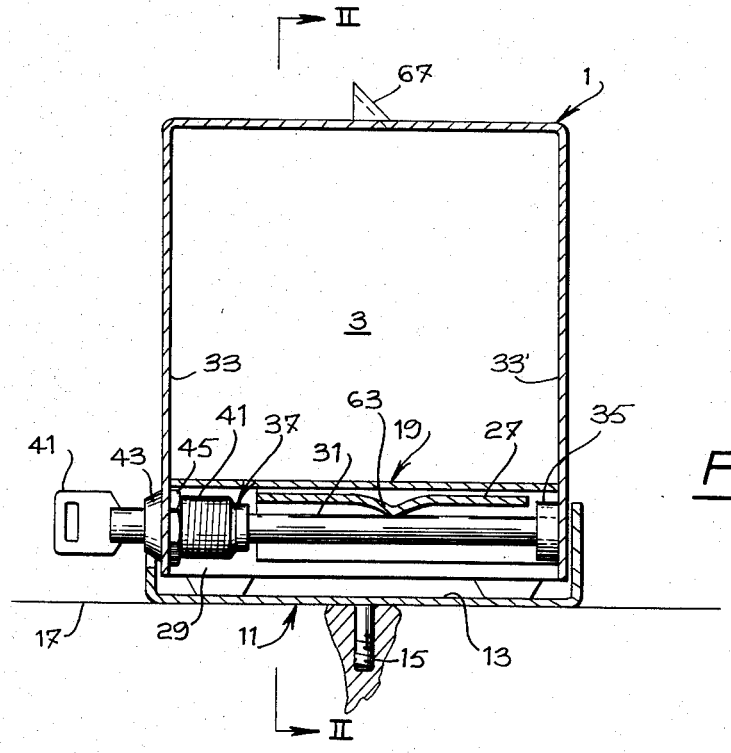
FIG. 3 is a transverse cross-sectional view of the assembly of FIG. 2, taken in a plane along line III—III of FIG. 2.

The safety box assembly further includes a mounting base 11 which has a bottom wall 13. Fasteners such as screws 15 extend through the bottom wall 13 and are driven into a supporting or receiving wall 17 (FIGS. 2 and 3). It will be noted that the screws 15 are located within the confines of the mounting base 11 so as to be hidden by the container 1 when the latter is mounted thereon, as clearly shown in the drawings, and therefore inaccessible if attempt is made to tamper with the assembly and remove it from the supporting wall 17.

The means to removably secure the container 1 on the mounting base 11, over the fasteners 15, comprise the following parts.

A first bracket 19, provided at the lower end of the door 7, adjacent the mounting base 11. This first bracket, which may be formed by bending the lower edge of the door 7 inwardly and twice at 90°, as clearly shown in FIGS. 1 and 2, defines a door locking wall 21 extending toward the base and located inside the enclosure 3 when the door 7 is closed, as shown in FIG. 2.

A second bracket 23 stands upward from the bottom wall 13 of the mounting base 11 and may be formed by bending the front edge of the bottom wall twice at 90°. The second bracket thus includes a front wall 25 which closes off the lower part of the access opening 5 and is generally in the same vertical plane as the door 7, as shown in FIG. 2 which also shows that the walls 21 and 25 are in space relationship, generally parallel. The second bracket 23 further includes a container locking wall 27 extending over and above the bottom wall 13 between the door locking wall 21 and the front wall 25. These three walls define therebetween a locking area 29 to which reference will be further made hereinafter.

The container 1 is secured on the mounting base 11, at the front end and in the manner shown in FIGS. 2 and 3, by a locking rod 31 slid into the locking area 29, means being provided on two opposed side walls 33, 33', of the container 1 to hold and releasably lock the locking rod 21 within the locking area 29. In the embodiment shown, the latter means comprise a bearing 35 (FIG. 3) secured to the side wall 33' to receive one end of the locking rod 31 while the other end of the rod 31 is born by a further bearing 37 secured to the other side wall 33 of the container 1. This second bearing 37 is also part of a key-operable locking mechanism of which the other part 39 (FIG. 1) is provided at the end of the rod 31 away from the one received in the bearing 35. This locking mechanism, operable by a key 41, is already known and need not be further detailed.

As will be gathered from FIGS. 1 and 3, the outer surface of the bearing 37 which lies inwardly of the locking area 29 is threaded as at 41 while the extreme end of the bearing 37 has a radial ring 43 intended to abut the outer surface of the side wall 33 when the threaded end 41 is slid through a suitable aperture (not shown) through the side wall 33. The bearing 37 is secured on the wall 33 by means of a nut 45 screwed onto the threaded end 41. As will easily be gathered from the above description, when the bearings 35 and 37, the latter with appertaining parts, are secured in position on opposed side walls 33 and 33', the rod 31 and locking mechanism part 39 can be slid through the bearing 37 and in the bearing 35 and finally locked by the key 41. It has been assumed here, as clearly shown in FIGS. 2 and 3, that the door 7 has been closed prior to the insertion of the locking rod 31 into the locking area 29, this situation being clearly shown in FIG. 2.

Since bearing 37 is secured to the side wall 33 in permanence, a cut 47 has of course to be provided in the first bracket 19, as shown in FIG. 1 so that bearing 37 may be avoided by the first bracket 19 when the door 7 is closed. Similarly, bearings 35 and 37 are likewise avoided by the second bracket 23 through the provision of similar cut-outs 49 and 51, again as shown in FIG. 1.

Releasable interlocking means 53 is provided at the end of the container 1 away from the opening 5 as well as at the corresponding end of the mounting base 13, as shown in FIG. 2. This releasable interlocking means 53 comprises a hook 55 formed at the end of the bottom wall 13 of the mounting bracket 11 and an upturned flange 57 secured in any known manner on the lower face of the bottom wall 59 of the container 1.

Preferably, rubber pads 61 are provided beneath the container 1 for use when the latter container 1 is made to rest on a surface other than the bottom wall 13 of the mounting base 11, to avoid scratches.

With the above description in mind and with particular reference to FIG. 2, it will be appreciated that when the locking rod 21 stands in the locking area 29, opening of the door 7 is prevented by abutment of the door locking wall 21 against the locking rod 31 or, preferably, the inward edge of the container locking wall 27 of the second bracket 23. On the other hand, lifting of the container 1 away from the mounting base 11, using the releasable interlocking means 53, is prevented by abutment of the locking pin 31 against the container locking wall 27 of the second bracket 23. The latter locking arrangement works of course in conjunction with the interlocking means 53 which may be considered as a pivoting construction wherein the pivoted parts are unattached.

Inversely, removal of the pin 31 from the locking area 29 after release of the locking mechanism, by means of the key 41, allows the forward end of the container 1 to be lifted and the container 1 drawn away from the mounting base 11 by withdrawal of the upturned flange 57 from the hook 55.

To ease the insertion of the locking pin 31 and avoid any wobbling of the container 1, the second bracket container locking wall 27 (FIG. 3) may be provided centrally with a downwardly directed ridge 63 suitably constructed to bear on and guide the locking rod 31 when the latter is inserted into the locking area 29.

Since the safety box assembly is intended to collect valuables and, in the context of use mentioned above, a narrow slot 65 may be provided through the top wall of container 1, this slot being of course sufficiently wide to permit the insertion of valuables in the enclosure 3 but be sufficiently narrow to prevent hand access thereto. Opportunity may also be taken to provide a handle 67 over the slot 65 to serve for carrying the container 1 when it is released from the mounting base 11.

Finally, depending on the particular size of door 7 used, the front end of the bottom wall 59 of the container 1 may be bent upward to form a stop 69 (FIG. 2) for the door when it is closed.

It will thus be appreciated, from the above description, that the present invention makes available a safety box assembly that can be put together and locked with extreme simplicity so that it can be achieved by any unskilled person. Inversely, the container 1 can be removed from the mounting base 11 extremely easily since it only requires the unlocking of the rod 31 and its removal from the locking area 29.

Also, and as mentioned above, the same locking rod 31 with its locking mechanism may be used on any container-mounting base combination. Inversely, any container-mounting base combination of the aforesaid type may be locked by the same locking rod-locking combination.

I claim:

1. A safety box assembly comprising:

(a) a container defining an enclosure for the safekeeping of valuables and having wall edges at one end defining an opening;

(b) a door hinged to said container for closing said opening;

(c) a mounting base having a bottom wall and means for fastening the bottom wall to a supporting surface;

(d) means to removably secure said container on said mounting base over said fastening means whereby to render said fastening means inaccessible, when said container is so secured, said securing means comprising, when said container is secured on the base;

a first bracket at the end of said door adjacent said mounting base, said first bracket having a door locking wall extending toward said base and located inside said enclosure in closed position of said door;

a second bracket upstanding from said bottom wall of said base and including a front wall closing off a lower part of said opening and disposed in space relationship with said door locking wall; said second bracket further including a container locking wall extending over and above said bottom wall between said door locking wall and said container locking wall; said door locking wall, said container locking wall and said front wall defining a locking area;

a locking rod slid into said locking area;

means on two opposed ones of said container wall edges to hold and releasably lock said locking rod within said locking area, and releasable interlocking means at the end of said container away from said opening and at the corresponding end of said mounting base to hold said container end on said mounting base;

whereby with said locking rod in said locking area, opening of said door is prevented by abutment of said door locking wall against said locking rod and lifting of said container away from said mounting base is prevented by abutment of said locking rod against said container locking wall and operative engagement of said interlocking means, removal of said locking rod from said locking area freeing said door which can then be opened and freeing said container which can then be lifted from said mounting base.

2. An assembly as claimed in claim 1, wherein said locking rod holding and locking means comprises:

bearing means on both said container opposed wall edges, with one of said wall edges having a rod aperture leading into one bearing means for the insertion of said locking rod into said locking area, and a key operable locking mechanism, at one end of said rod and in said one of said bearing means, suitable to lock said rod in said locking area.

3. An assembly as claimed in claim 1, wherein said first bracket is an integral part of said door formed by the bottom edge thereof bent twice at 90°.

4. An assembly as claimed in claim 1, wherein said second bracket is formed by the front edge of said bottom wall bent twice at 90°.

5. An assembly as claimed in claim 1, wherein said releasable interlocking means comprise: a hook formed at the end of said bottom wall away from said container opening and an upturned flange projecting rearwardly from said end of said container away from said opening, said upturned flange being receivable within said bottom wall hook to hold said container end on said mounting base.

6. An assembly as claimed in claim 1, wherein said door is hinged to said container for pivotal action about an axis perpendicular to said bottom wall of said mounting base.

7. An assembly as claimed in claim 1, further comprising a slot through the top wall of said container to give limited access thereto for the insertion of valuables but of a size suitable to prevent hand access thereinto.

8. An assembly as claimed in claim 7, including a handle formed around said slot for carrying said container when released from said mounting base.

9. An assembly as claimed in claim 1, wherein one of said container side edges is bent up inwardly of said enclosure to stand behind said door locking wall to serve as stop therefor, when said door is closed.

10. An assembly as claimed in claim 1, wherein said container locking wall is formed, centrally thereof, with a downward ridge adapted to bear on and guide said locking rod when the latter is inserted in said locking area.

* * * * *